US006883425B2

(12) United States Patent
Goss

(10) Patent No.: US 6,883,425 B2
(45) Date of Patent: Apr. 26, 2005

(54) SCREEN PRINTING DEVICE

(76) Inventor: Duke W. Goss, 127 10th St. S., Kirkland, WA (US) 98033

( * ) Notice: Subject to any disclaimer, the term of this patent is extended or adjusted under 35 U.S.C. 154(b) by 0 days.

(21) Appl. No.: 10/243,177

(22) Filed: Sep. 13, 2002

(65) Prior Publication Data

US 2004/0050267 A1 Mar. 18, 2004

(51) Int. Cl.[7] ..... B41F 15/06; B41F 15/34
(52) U.S. Cl. ..... 101/127.1; 101/126; 101/115
(58) Field of Search ..... 101/114, 123, 101/124, 126, 127, 127.1, 129, 128.1, 115, 474

(56) References Cited

U.S. PATENT DOCUMENTS 5,127,321 A * 7/1992 Proffer ..... 101/115
5,355,791 A * 10/1994 Benedetto et al. ..... 101/126
5,613,436 A * 3/1997 Taylor ..... 101/115
5,622,108 A * 4/1997 Benedetto et al. ..... 101/126
5,699,742 A * 12/1997 Ahrens et al. ..... 101/486
5,806,425 A * 9/1998 Newman et al. ..... 101/127.1

* cited by examiner

*Primary Examiner*—Leslie J. Evanisko
(74) *Attorney, Agent, or Firm*—Delbert J. Barnard

(57) ABSTRACT

A screen frame (24) is detachably connected to a support frame structure (22, 124, 134) by locator pins (46, 118) and locator pin sockets (56, 112, 136). An elongated support arm (26) supports either a light box (34) or a work piece support (36) in a proper position relative to the print frame (24). The light box (34) and the work piece support (36) are interchangeable on the support arm (26).

16 Claims, 11 Drawing Sheets

FIG. 2
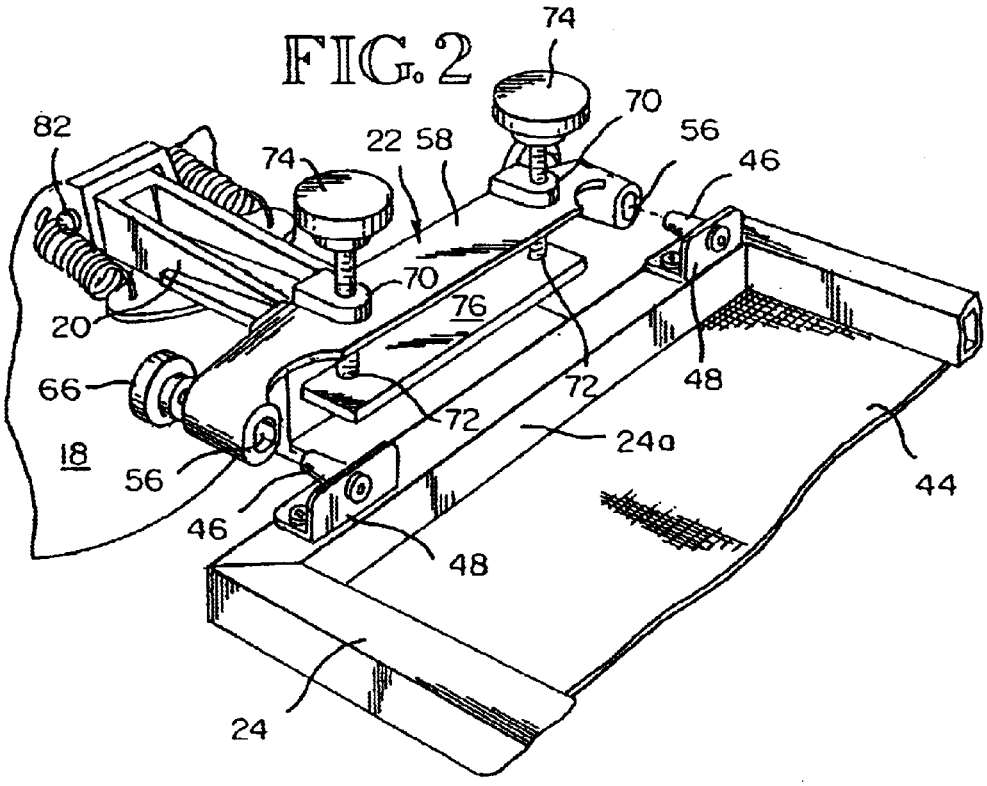
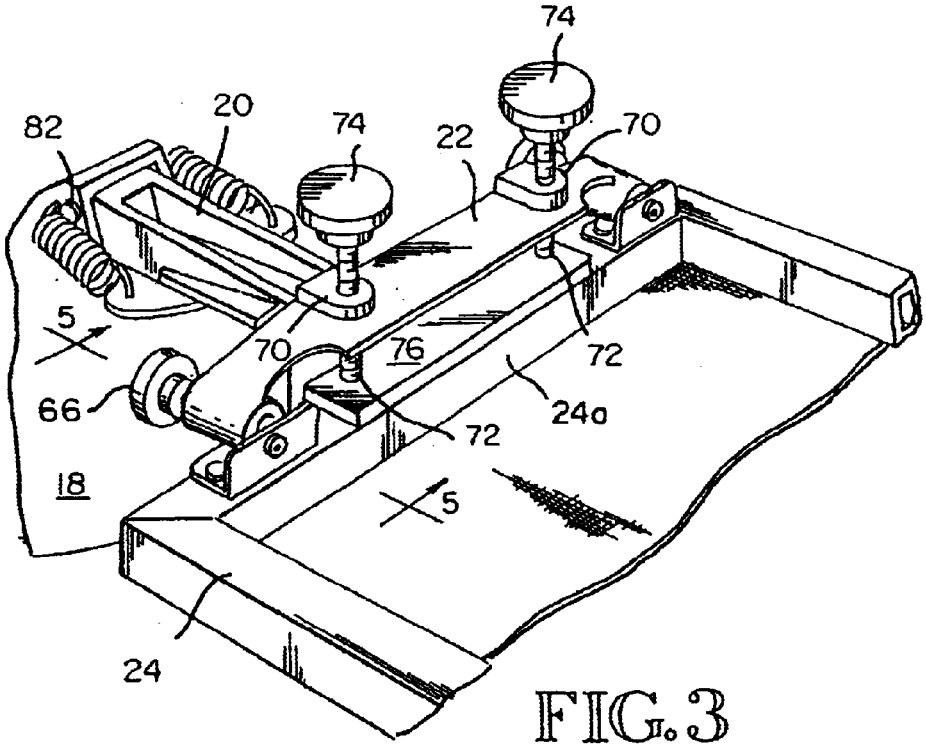
FIG. 3

FIG. 4
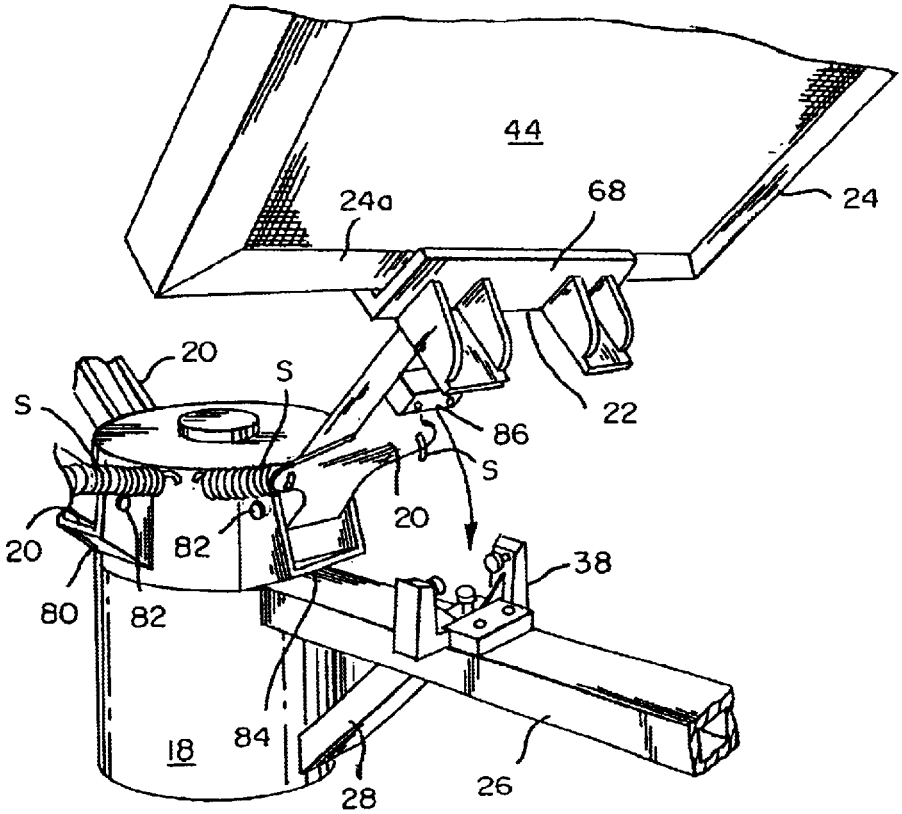
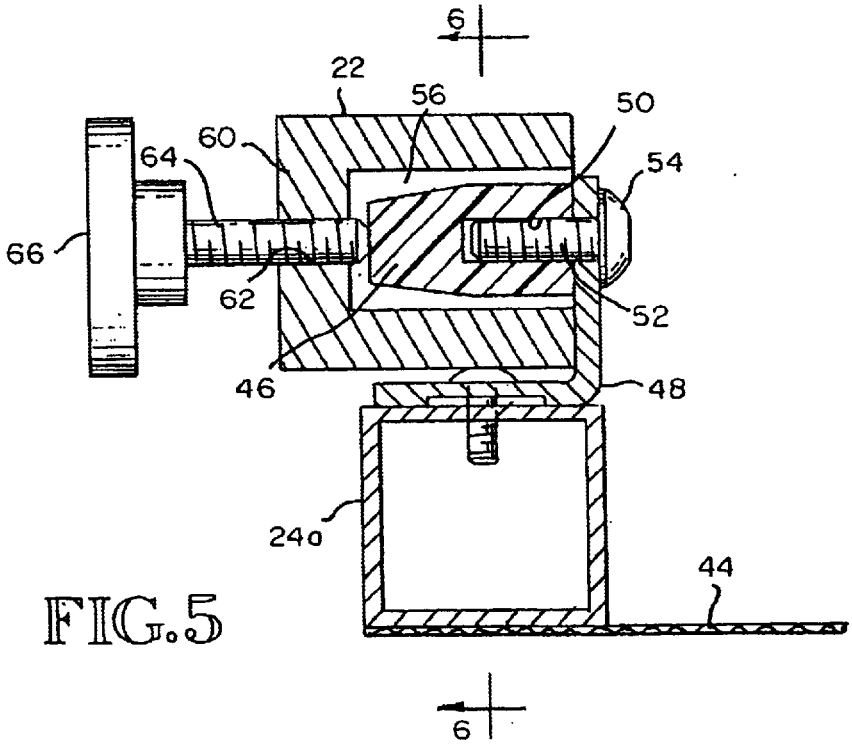
FIG. 5

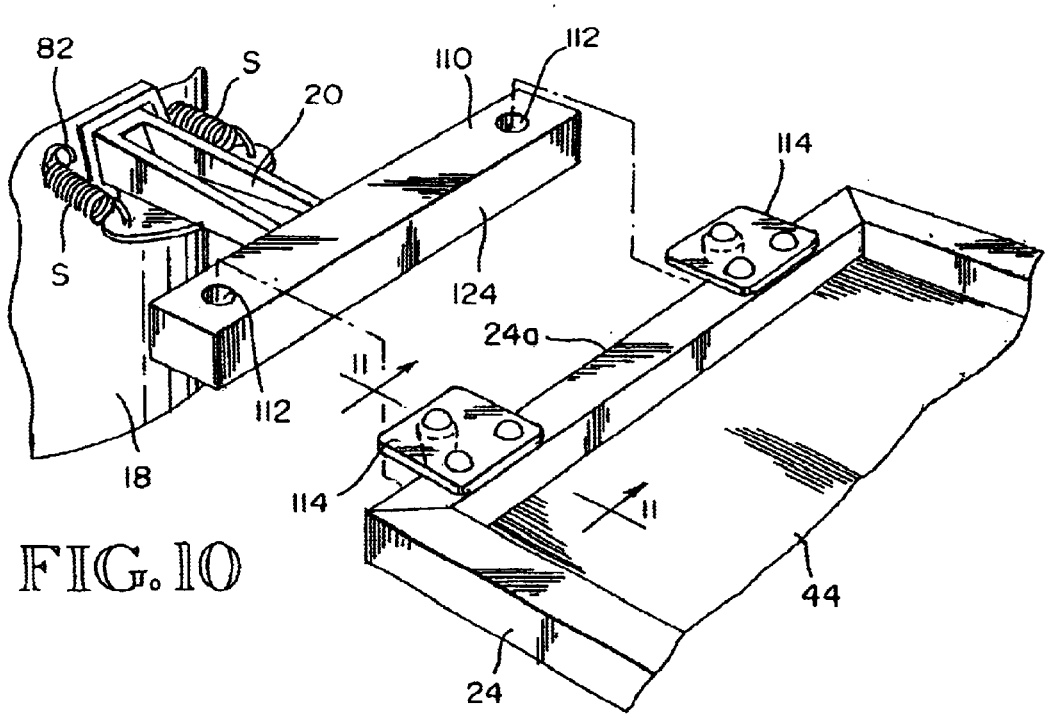
FIG. 10
FIG. 11
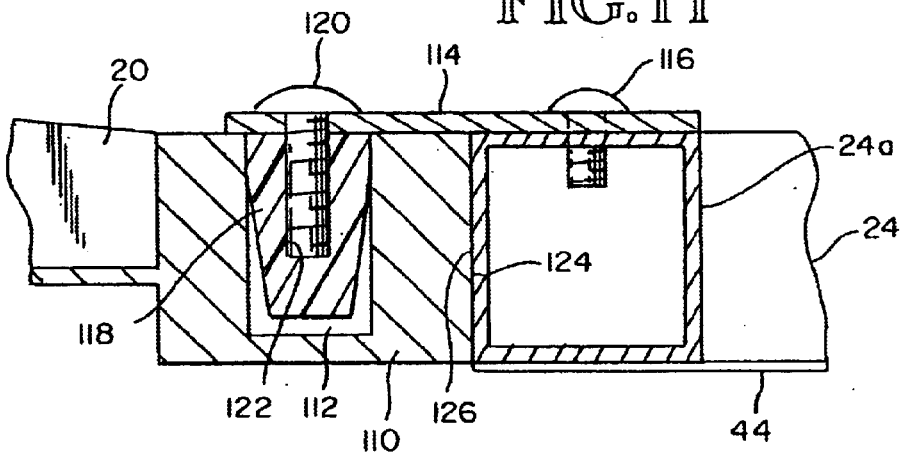

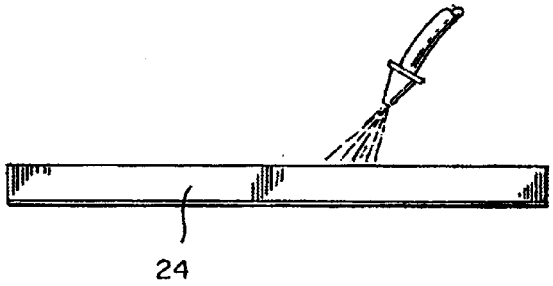
FIG. 15
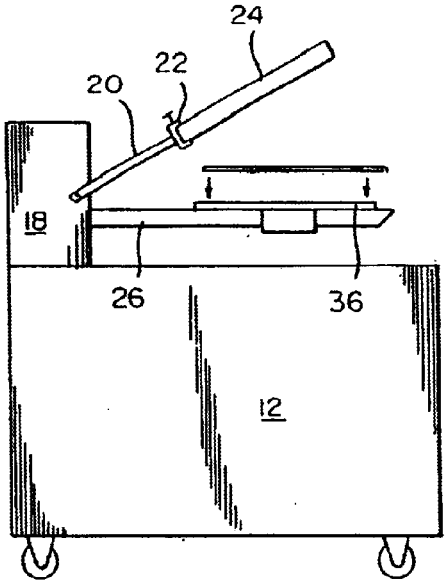
FIG. 16
FIG. 17
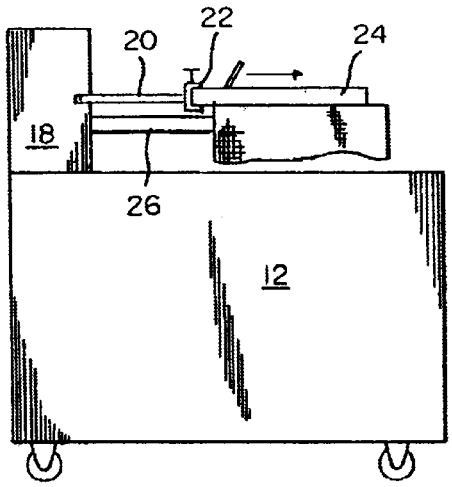

SCREEN PRINTING DEVICE

TECHNICAL FIELD

This invention relates to screen printing. More particularly, it relates to a screen printing device that is constructed to facilitate use of the device during the various stages of screen printing.

BACKGROUND OF THE INVENTION

Preparatory to screen printing, art work and/or indicia that is to be printed must be placed on the print screen. This is commonly done by printing the image on the print screen by use of a process that requires the presence of a light box that includes ultraviolet lighting. The light box and print screen need to be supported during the printing procedure. A photographic emulsion is applied to the print screen and then the print screen is stored in the dark before exposure of the emulsion. After exposure, the screen is washed to remove a part of the emulsion that was not hardened by the ultraviolet light. Then, an article to be printed, i.e. a work piece, such as a garment, must be supported. The print screen must be properly positioned on the work piece and supported in that position. Then, ink is applied to the print screen for the purpose of printing the image on the work piece. At times, it is desired to apply heat to the printed work piece to increase the drying speed of the ink. There is a need for a screen printing device that facilitates the performance of all of the above described functions and makes possible the quick and easy handling of the components and a proper positioning of the print screen relative to the first light box and then the work piece. An object of this invention is to provide a screen printing device that fulfills this need.

For background purposes, reference is made to U.S. Pat. No. 5,355,791, granted Oct. 18, 1994, to John R. Benedetto and William Gillespie, and U.S. Pat. No. 5,622,108, granted Apr. 22, 1997, to John R. Benedetto, William Gillespie, James W. Palmeroy, Duke Goss and Charles J. Palmeroy, and to the reference patents listed in these patents.

BRIEF SUMMARY OF THE INVENTION

The screen printing device of the present invention is basically characterized by a screen frame support, a screen frame including a print screen, and a pin and socket connection between the screen frame and the screen frame support. This connection comprises at least two spaced apart locator pins and complementary pin sockets that are sized, shaped and positioned to receive the locator pins. The connection adapts the screen frame for connection to the screen frame support by moving the screen frame towards the screen frame support and the locator pins into the locator pin sockets. When the locator pins are within the locator pin sockets, the screen frame is in a predetermined position relative to the screen frame support.

In one embodiment, the locator pins and the locator pin sockets are substantially parallel with the print screen. Preferably, the screen frame support includes a clamp plate and at least one clamp screw. The clamp plate is positioned to be movable against a portion of the screen frame when the locator pins are within the locator pin sockets. The clamp screw is adapted to move the clamp plate into clamping engagement with the screen frame. The connection may include two spaced apart clamp screws that are attached to the clamp plate. The locator pins may be connected to the screen frame and the locator pin sockets may be a part of the screen frame support.

According to an aspect of the invention, a pivot arm may have first and second ends. The first end may be mounted for pivotable movement about a horizontal axis. The second end may be connected to the screen frame by the pin and socket connection. In one embodiment of the invention, the screen printing device may include a support column having a rotor that is mounted for rotation about a vertical axis. The first end of the screen frame support is mounted on the rotor for pivotal movement about a horizontal axis. The second end of the screen frame support is connected to the screen frame by the pin and socket connection.

In another embodiment of the invention, the locator pins and the locator pin sockets are both perpendicular to the print screen. The locator pins are attached to the screen frame and the locator pin sockets are in the screen frame support. Preferably, in the second embodiment, the screen frame support has a top portion having at least three sides. Each side includes a top edge portion. The top edge portions are substantially within a common plane.

According to another aspect of the invention, the screen printing device has a screen frame support that is on a support base. The screen frame is connectable to the screen frame support and the screen frame includes a print screen. The support base also includes a lower support. A light box including upwardly directed lights, and a portion below the lights, is sized and shaped to fit on and be supported by the lower support. A work piece support table is provided. It includes an upper work piece support surface and a lower portion that is sized and shaped to fit on and be supported by the lower support. The light box and the work piece support are interchangeably mounted on the same lower support. As a result, the light box, with its light directed upwardly, can be placed on and supported by the lower support. Then, after use, the light box can be removed from the lower support and the work piece support, with its work piece support surface directly upwardly, can be placed and be supported by the lower support.

In one embodiment, the lower support is an elongated support arm that extends in cantilever fashion from a portion of the support base. The portion of the light box below the lights that is sized and shaped to fit on and be supported by the lower support is a socket that is sized and shaped to receive the support arm. In this embodiment, the lower portion of the work piece support table that is sized and shaped to fit onto the lower support is also a socket that is likewise sized and shaped to receive the support arm.

Other objects, advantages and features of the invention will become apparent from the description of the best mode set forth below, from the drawings, from the claims, and from the principles that are embodied in the specific structures that are illustrated and described herein.

BRIEF DESCRIPTION OF THE SEVERAL VIEWS OF THE DRAWING

Like reference numerals and letters are used to designate like parts throughout the several views of the drawing, and:

FIG. 2 is a fragmentary pictorial view of an end portion of a screen frame spaced outwardly from a screen frame support hat includes a clamp for detachably connecting the screen frame to a mounting post;

FIG. 3 is a view like FIG. 2 but showing the clamp connected to the end portion of the screen frame;

FIG. 4 is a fragmentary pictorial view of a lower portion of the clamp and a swing arm which mounts the clamp onto the mounting post, such view showing a portion of an elongated support arm that extends forwardly in cantilever fashion from the mounting post, such arm including a cradle for receiving a portion of the swing arm;

FIG. 5 is a sectional view taken substantially along line 5—5 of FIG. 3;

FIG. 10 is a view like FIG. 2, but showing a modified mount for mounting the printing screen onto the swing arm;

FIG. 11 is a sectional view taken substantially along line 11—11 of FIG. 10;

FIG. 15 is a side elevational view of the screen frame, showing ink being applied to the print screen;

FIG. 16 is a view like FIG. 12, but showing a work piece support table on the support arm in place of the light box, and showing a work piece spaced above the support table;

FIG. 17 is a view like FIG. 16, but showing the work piece positioned on the work piece support table, and showing the screen frame and printing screen down on the work piece, and showing a tool for spreading ink over the printing screen;

DESCRIPTION OF THE PREFERRED EMBODIMENT

Figure 1:
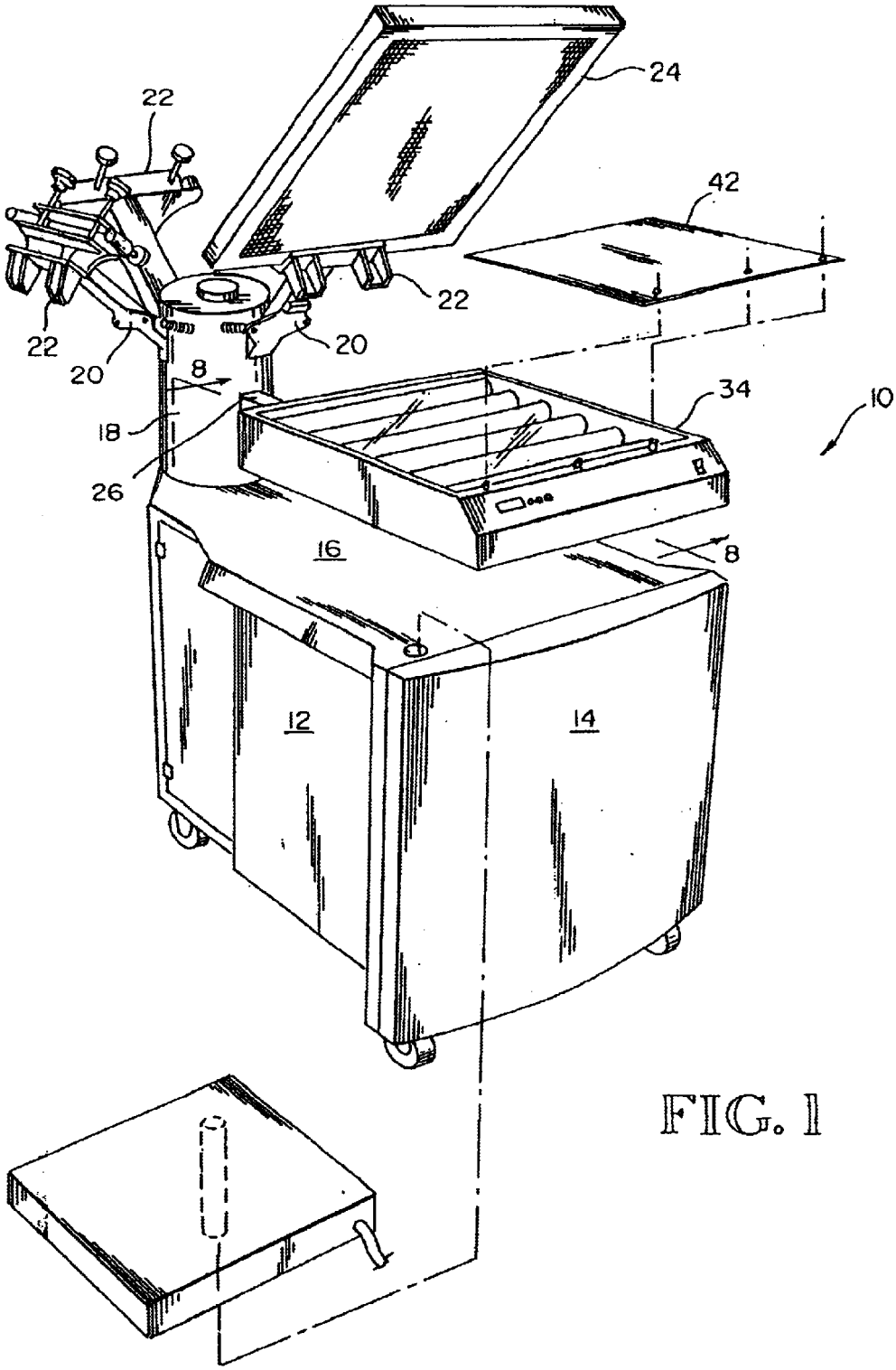
FIG. 1 is a pictorial view of an embodiment of the screen-printing device of the invention, taken from above and looking toward the front and one side of the device, and showing some parts spaced from their in-use positions.

The screen printing device 10 shown by FIG. 1 includes a base 12 that is preferably a cabinet or housing 12 having a front door or cover 14. When a door is used, it is hinge connected to the housing 12. When a cover is used, it is movable in its entirety onto and off from the front of the housing 12. A housing having a snap-on, pull-off cover is shown by my co-pending design patent application Ser. No. 29/158,053.

In this embodiment of FIG. 1, the cabinet 12 has a top 16 and at its rear includes a post 18 that serves as a screen frame support. At least one swing arm 20 is connected at one end to the post 18 for pivotal up and down movement about a horizontal axis. A clamp 22 is mounted on the second or outer end of the swing arm 20. The clamp 22 provides a detachable connection between it and a screen frame 24. In the embodiment of FIG. 1, the upper portion of the post 18 rotates and supports three swing arms 20. Each arm 20 is pivotally connected at its first or inner end to the rotating upper portion of the post 18 and each supports a clamp 22 at its second or outer end.

A support arm 26 projects horizontally outwardly from non-rotating lower portion of the post 18. This support arm 26 is shown in several of the views but it is best shown in FIGS. 4 and 8.

Support arm 26 may include a diagonal brace 28 having a lower end 30 that is connected to the lower portion of the post 18 that does not rotate and an upper end 32 that is connected to the arm 26 at a location spaced outwardly from the post 18. As shown in FIGS. 4 and 8, the brace 28 may extend at a 45° angle relative to both post 18 and arm 26.

Support arm 26 forms three support functions. Firstly, it supports a light box 34 that is slidable endwise of the support arm 26, on and off the support arm 26. Secondly, it supports a work piece support table 36 that is also slidable endwise of the support arm 26, onto and off from the support arm 26. Thirdly, it supports and positions the swing arms 20. As shown by FIG. 4, arm 26 includes a cradle 38 that is positioned to receive a portion of each swing arm 20 that is between its inner and outer ends.

Figure 8:
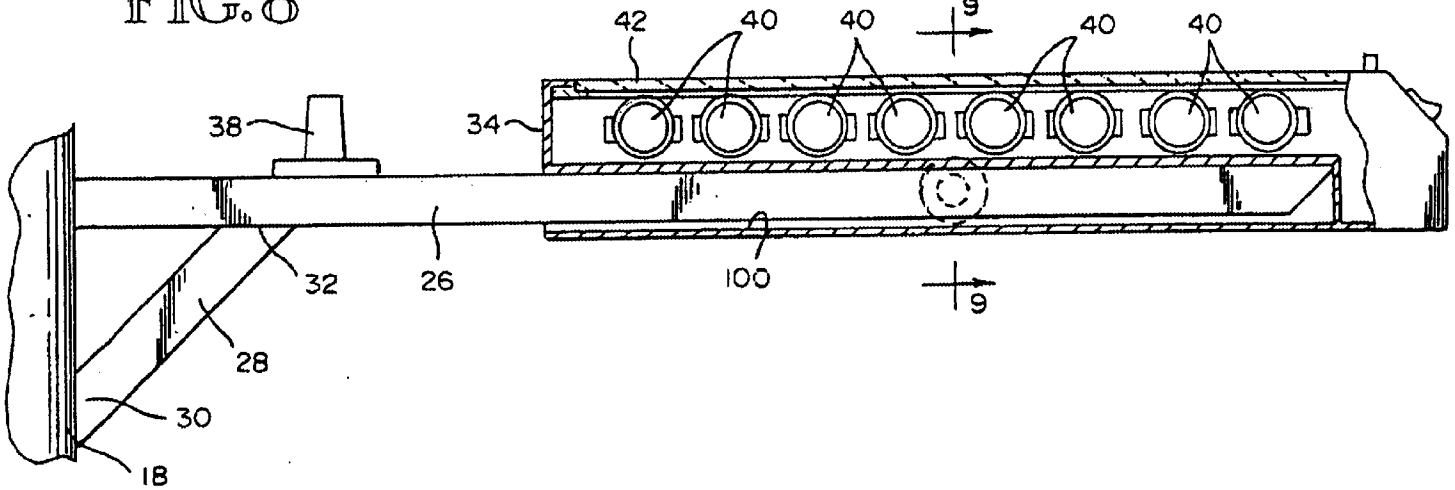
FIG. 8 is a side elevational view of the support arm, showing a fragmentary part of the post and showing a light box in section.
Figure 9:
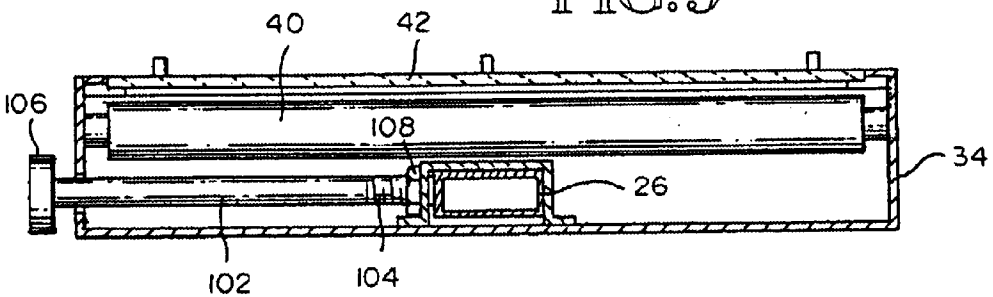
FIG. 9 is a sectional view through the light box and the support arm, taken substantially along line 9—9 of FIG. 8.

The light box 34 is best shown by FIGS. 1, 8, and 9. It has a bottom, two sides and two ends. A plurality (e.g. eight) fluorescent lamps 40 are mounted side-by-side in the light box 34. The fluorescent lamps 40 emit ultraviolet (UV) light. The arrangement of the lamps 40 is well known and for that reason does not need to be described in any great detail. The top of the light box 34, above the lamps 40, is closed by a translucent panel 42 that helps diffuse the light that is emitted from the several lamps 40. This use of a diffuser panel 42 is also well known.

Screen frame 24 is in the nature of a tray. It has two sides and two ends that are connected together at four corners. The sides and ends may be constructed from tubular stock, e.g. square aluminum tubing. (see FIG. 5). The screen frame has a rectangular plan form. Its top is open. Its bottom is closed by a print screen 44 formed from a fine mesh fabric. Print screen 44 is stretched across the side and end members of screen frame 24 and is connected to the members in a well-known manner. The mesh size (strands per inch) is a variable. Print screens have been used which fall within the range of from 25 strands per inch to 495 strands per inch, with the larger number of strands creating finer detail images.

According to the invention, a substantially precise connection is made between the screen frame 24 and the clamp structure 22. As best shown by FIGS. 2 and 5, a pair of horizontal locator pins 46 are provided at one end of the screen frame 24. A pair of angle members 48 are provided, one for each locator pin 46. The horizontal leg of each angle member 48 is connected to the frame member 24*a*, such as by use of screws, bolts, or rivets. The locator pins 46 are mounted on the vertical legs of the angle members 48. As shown by FIG. 5, each locator pin 46 may include a socket 50 which is internally threaded for receiving the threaded shank 52 of a screw 54. Screw 54 connects the locator pin 46 to the vertical leg of the angle member 48.

Figure 6:
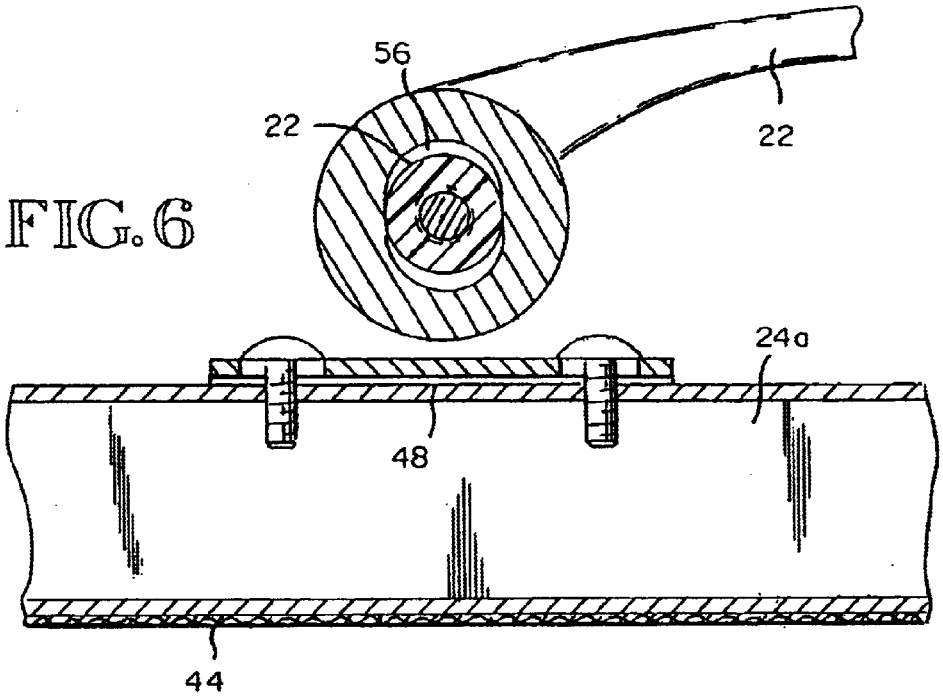
FIG. 6 is a sectional view taken substantially along line 6—6 of FIG. 5.

The clamp structure 22 may include a socket 56 at each end of a transverse frame member or bar 58. As shown by FIG. 5, each socket 56 is formed in a member that includes a rear wall 60 through which an internally threaded opening 62 extends. The threaded shank 64 of a screw 66 is received within each opening 62. Screw 66 is rotated for the purpose of adjusting the depth that the locator pin 46 is allowed to extend into the socket 56. As shown by FIG. 5, the first half of the locator pin 46 is cylindrical and the second half, or remaining portion, tapers as it extends towards the rear wall 60 of the socket 56. This taper facilitates insertion of the locator pins 46 into the sockets 56. As shown by FIG. 6, the socket 56 has a width that is substantially equal to the width of the locator pin 46 where it is attached to the vertical leg of the angle member 48. In the vertical direction, the socket 56 is elongated. This construction of the socket 56 and the locator pin 46 will allow some vertical movement of the locator pin 46 in the socket 56 while sideways movement is substantially prevented.

Referring to FIG. 4, the bottom of each clamp structure 22 includes a bottom wall or plate 68 on which a lower surface of the frame member 24*a* rests as shown by FIGS. 2 and 3, the clamp structure 22 includes a pair of thickened structures 70 which include vertical openings that are threaded to receive threaded shanks of adjustment screws 72. Each adjustment screw 72 includes a knob 74 at its upper end. The lower end of each threaded shank 72 extends into and is turnable within openings formed in a clamp plate 76. When the knobs 74 are rotated, the threaded shank 72 are also rotated and they move up and down in the openings in the members 70. The threaded shank 72 rotate relative to clamp plate 76 but clamp plate 76 moves up and down with the shanks 72 relative to the members 70.

When it is desired to connect the screen frame to the clamp 22, the knobs 74 are rotated in the direction that raises the clamp plate 76 away from the clamp plate 68. When the vertical space between plates 76, 68 is greater than the thickness of the frame member 24*a*, the screen frame 24 is moved towards the clamp structure 22 to place the locator pins 46 in the sockets 56. When the locator pins 46 are within the sockets 56 as far as they will go, and the frame member 24*a* between the plates 76, 68, and the necessary adjustments are made, the knobs 74 are rotated in the direction that causes the clamp plate 76 to move downwardly towards the frame member 24*a*.

Figure 7:
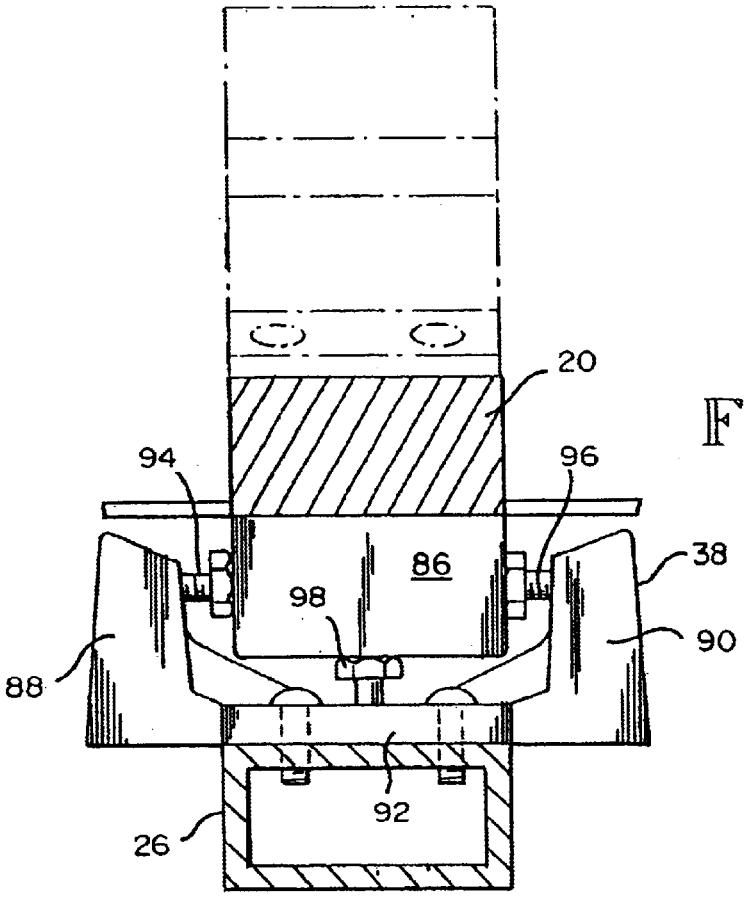
FIG. 7 is a cross sectional view taken through the support arm, presenting an elevational view of the cradle and a sectional view of the swing arm for the clamp.

Referring to FIG. 4, the rotor at the top of the post 18 includes one or more mounting brackets 80. As best shown in FIG. 1, in the illustrated embodiment, three mounting brackets are provided. Each mounting bracket is secured to the rotor and has spaced apart sides. The inner end of one of the swing arms 20 is positioned between the two sides. A pivot pin 82 extends first through one side, then through the inner end of the swing arm 20, and then through the second side. Pin 82 provides a pivot axis about which the swing arm 20 pivots. Each bracket 80 includes a stop 84 on which its swing arm rests. Springs S extend between the rotor and portions of the swing arms 20 spaced outwardly from the pivot pins 82. The springs S pull on the swing arms, tending to pull them upwardly away from the stops 84. Each swing arm 20 includes a block 86 that depends from the swing arm 20 at a location between where the springs are attached to arm 20 and the clamp structure 22. When a swing arm 20 is moved downwardly, the springs S will stretch, permitting the movement. The block 86 on the swing arm 20 will enter into the cradle 38, as shown in FIG. 7. Referring to FIG. 7, cradle 38 has two sides 88, 90 and a bottom 92. Side 88 includes a threaded opening that receives the threaded portion of a first adjustment screw 94. In like fashion, side 90 includes a threaded opening which receives a threaded portion of a second adjustment screw 96. Screws 94, 96 are horizontal and are substantially coaxial. Bottom 92 includes a threaded opening that receives the threaded portion of a third adjustment screw 98. As can be appreciated, screws 94, 96 are adjusted, one end in the other out, until the heads of these screws 94, 96 contact the sides of the block 86. Vertical adjustment screw 98 is either screwed in or screwed out for the purpose of adjusting the position of its head. When the swing arm 20 is down, the block 86 rests on the head of the adjustment screw 98. As will be appreciated, adjustment of screw 98 will provide a way of positioning the frame 24 in a substantially horizontal position, over either the light box 34 or the work piece support. Adjustment of the screws 94, 96 will adjust the sideways position of the screen frame 24. As earlier explained, the adjustment screws 64 also function to adjust the position of the screen frame 24 on the clamp structure 22.

As shown by FIGS. 8 and 9, an elongated socket 100 is formed in the lower central portion of the light box 34. It receives the support arm 26. A long adjustment screw 102 having a threaded end portion 104 and a knob 106 extends through one side of the light box 34. The threaded portion 104 threads into a nut 108 that is connected to a sidewall of the socket 100. The threaded portion 104 extends through the nut and through an opening in the sidewall of the socket 100. When adjustment screw 102 is tightened, by rotation of the knob 106, the inner end of the screw 102 presses against the support bar 26 and clamps the light box 34 to the support arm 26. The work piece support 26 also has an elongated socket 110' that is sized to receive the support arm 26. Socket 110' include a vertical adjustment screw having a knob 112' its lower end. When knob 112' is rotated to tighten the screw, the screw clamps the socket 110' to the support arm 26. When the control knob 112' is rotated in the opposite direction, its upper end portion moves away from the support arm 26, and the socket 110' and the work piece support 36 are free to be slid endwise onto or off from the support arm 26.

A separate print screen 24 may be connected to each clamp structure 22. The adjustments may then be made so that each of the print screens 24 will be in a proper position relative to either the light box 34 or the work piece support 36. The light box 34 can be removed from the support arm 26 and replaced by the work piece support 36 and the print screen 24 will remain in its position. The same is true when there is a switch back from the work piece support 36 to the light box 34. Also, the screen frame 24 can be removed and then replaced and it will come back to the same position that it was in before it was removed. The other two print screens 24 attached to the other two swing arms 20 may be adjusted so that they will also be in a proper position relative to the light box 34 and the work piece support 36 when it is their turn to be in a front position over the top 16.

FIGS. 10 and 11 show a modified way of connecting the print screen 24 to a swing arm 20. In this embodiment, the swing arm 20 includes a transverse bar 110 in place of the clamp structure 22. Bar 110 includes a pair of laterally spaced apart, vertical socket openings 112. The frame member 24*a* includes a pair of plates 114, each of which is fastened by a screw 116, or the like, to the frame member 24*a*. As shown by FIG. 11, the plates 114 extend horizontally from the top of the frame member 24*a* and at a location spaced from the frame member 24*a* carry a locator pin 118. The locator pins 118 may be connected to the plate 114 by a screw 120 that extends downwardly through an opening in the plate 114 and screws into a threaded socket 122 in the locator pin 118. Also, the locator pins 118 may be downwardly tapered. The locator pins 118 are spaced away from the frame member 24*a* at such a distance that the front surface 124 of member 110 is substantially against the frame member surface 126 when the locator pins 118 are within the sockets 112. The member 110 sits in a nook formed at its top by the plate 114 and on one side by the frame member wall 126. When the member 110 is within this nook and the locator pins 118 are within the sockets 112, the screen frame 24 is substantially locked in a set position relative to the member 110 and the swing arm 20. An advantage of this embodiment, is that a screen frame 24 can be easily installed on the member 110 by positioning the locator pins 118 above the sockets 112, and then pushing downwardly on the frame 24. This moves the locator pins 118 into the sockets 112 and the member 110 into the above described nook. It is also both easy and quick to remove the screen frame 24 from the member 110.

Figure 12:
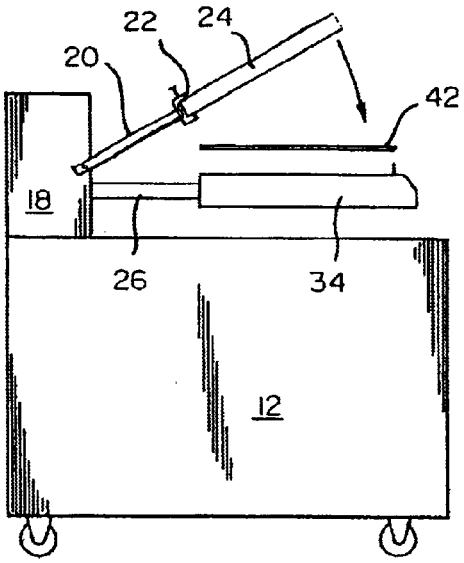
FIG. 12 is a somewhat schematic, side elevational view of the screen printing device, showing a printing screen connected to the swing arm and the swing arm in an up position, and showing a light box on the support arm.
Figure 13:
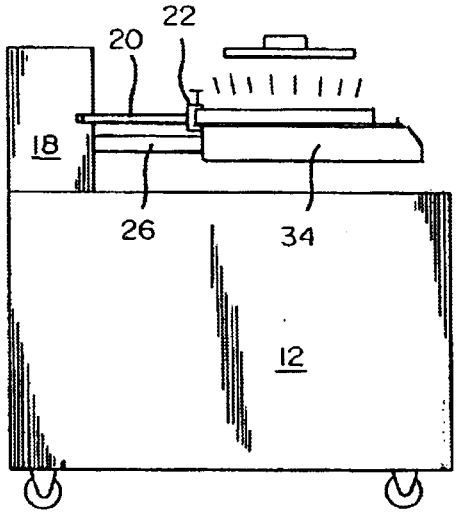
FIG. 13 is a view like FIG. 12, but showing the swing arm and screen frame in a down position.
Figure 14:
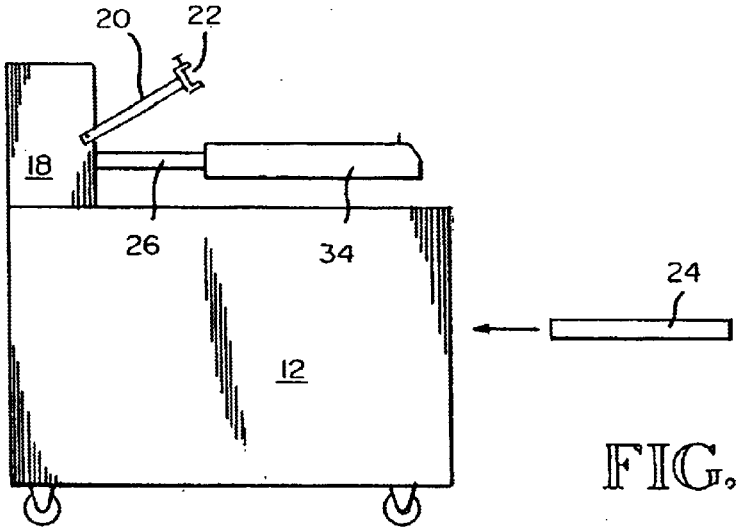
FIG. 14 is a view like FIGS. 12 and 13, but showing the screen frame removed from the swing arm and in the process of being moved into a cabinet forming a base for the device.

FIG. 12 shows the light box 34 positioned on the support arm 26. A screen frame 24 is mounted on a swing arm 20 and is elevated but in a position to be downwardly towards the light box 34. FIG. 13 shows a light box 34 being operated to expose an emotion on the printing screen 44. FIG. 14 shows the screen frame 24 removed from the arm 20 and in the process of being moved into the cabinet 12. At this time, the front cover 14 is removed from the cabinet 12 and shelves in the cabinet 12 are exposed. The screen frame 24 is moved into the cabinet 12 and onto one of the shelves. The light box 24 maybe supported on a shelf in the housing 12 when it is not being used. In a like fashion, the work piece support 36 maybe supported on a shelf in the housing 12 when it is not being used.

Figure 18:
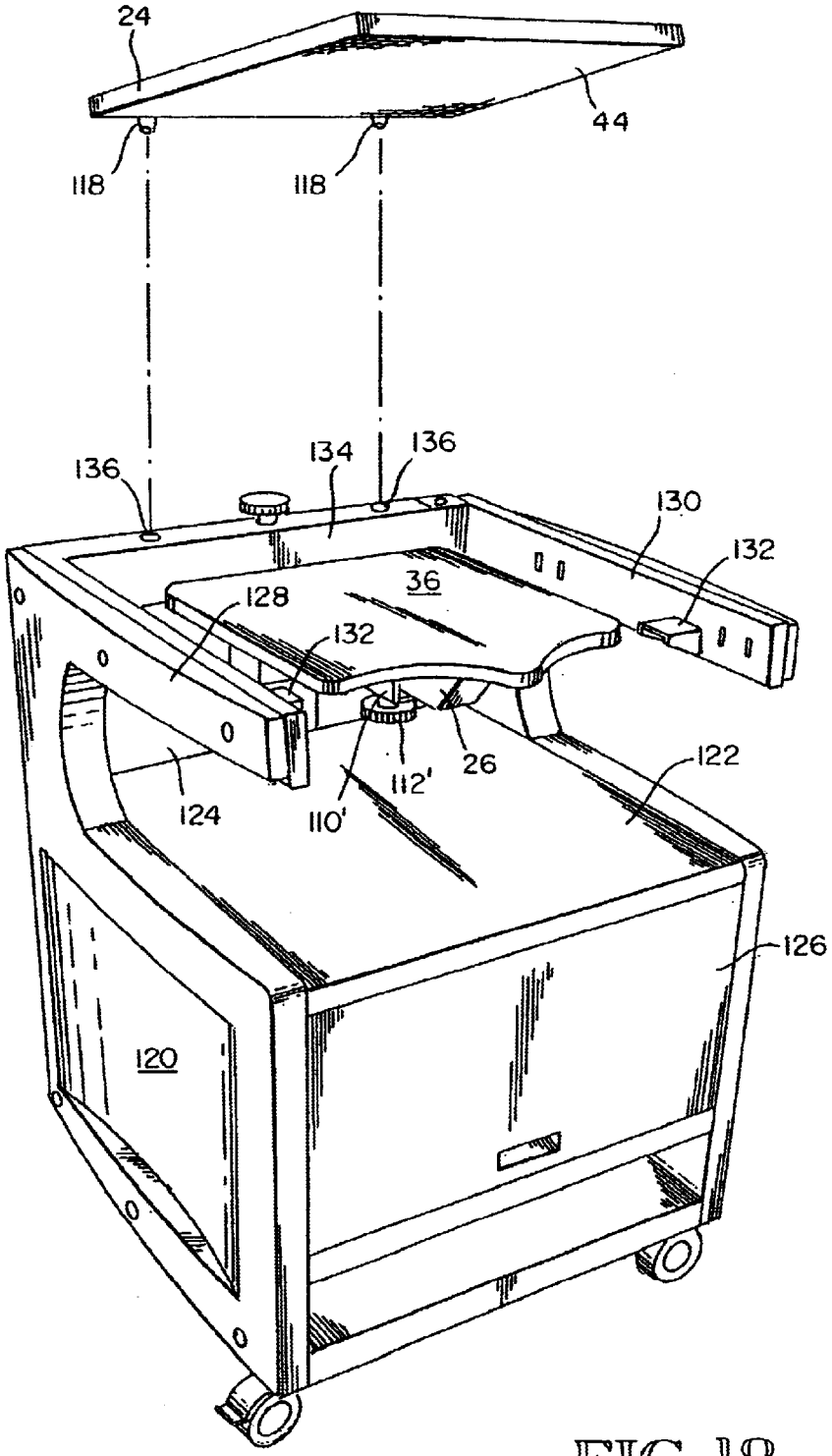
FIG. 18 is a pictorial view of a modified screen printing device, such view showing a support arm projecting forwardly from an upper rear portion of a housing and showing a work piece support on the support arm and a printing screen spaced above the top of the housing and above the work piece support.

FIG. 18 shows another embodiment of the invention. In this embodiment, the base or housing 120 has a top 122 and a back wall 124 that projects upwardly from the top 122. Housing 120 may include shelves and a front door 126 that is constructed to be open so as to provide access to the shelves. The rear wall 124 includes a pair of side arms 128, 130 that project forwardly from the wall 124 in cantilever fashion. The side walls include brackets 132 on which forward side portions of the screen frame 24 sit. In this embodiment, the screen frame 24 includes the locator pin assemblies that are shown in FIGS. 10 and 11. A plate 114 is provided that is connected to the upper part of the frame member that is directed rearwardly. Each plate 114 carries a locator pin 118, in the manner described above. The side wall, the frame member and the plate 114 form a nook for receiving a rear member 134 that is atop the rear wall 124. The screen frame 24 is positioned above the members 128, 130, 134, with the locator pins 118 in alignment with the socket openings 136. Then the screen frame 24 is moved downwardly, with the locator pins 118 entering into the sockets 136. Downward movement proceeds until the forward side portion of the frame 24 are on the brackets 124. As can be seen, the screen frame 24 can be easily installed and removed from its position at the top of the housing 120. This embodiment includes a support arm 26 that is like the support arm 26 that has been previously described. The light box used with this embodiment is like the light box used in the first embodiment. The same is true with the respect to the work piece support 36. Accordingly, the socket below the light box can be aligned with the support arm 26 and then the light box can be slid rearwardly onto the support arm 26, and secured in place. When it desired to remove the light box, its clamp screw 102 is loosened and the light box 34 is slid off the support arm 26. Then, the socket below the work piece support 36 can be aligned with the support arm 26 and then moved onto the support arm 26, and be connected to the support arm 26 by rotating the knob 112 (FIG. 18).

As can be seen, the screen frame 24, the light box 34 and the work piece support 36 can all be easily installed onto or removed from the housing or base 12, 120. As a result, essentially all the functions of a screen printing operation can be reformed by the equipment that has been illustrated and described.

Figure 19:
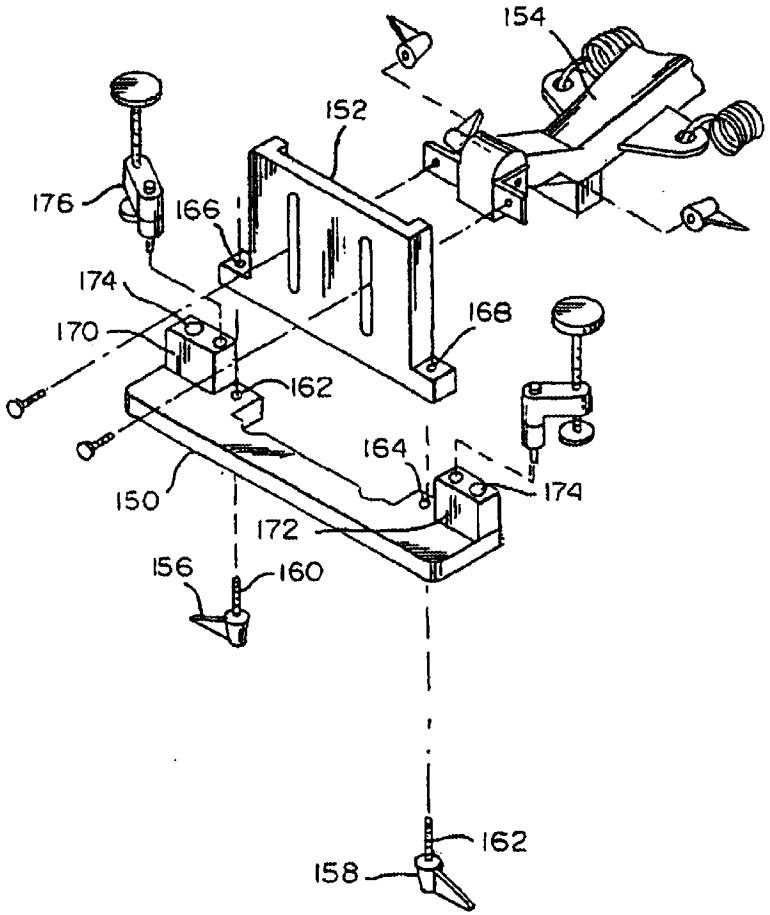
FIG. 19 is a fragmentary pictorial view of a print screen clamp usable with the print screen shown by FIGS. 10 and 11.
Figure 19:
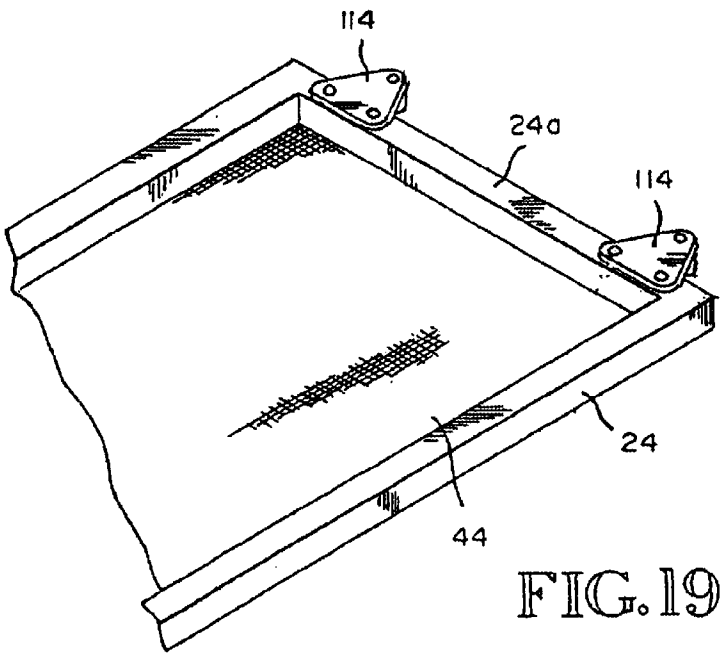
Figure 20:
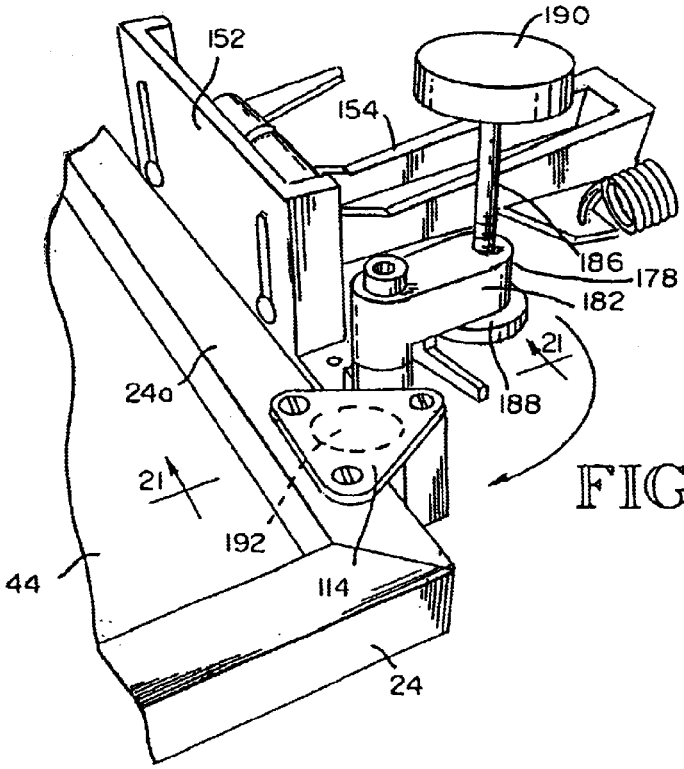
FIG. 20 is another fragmentary pictorial view of the print screen clamp shown by FIG. 19, such view showing one of the clamps in the foreground and omitting the second clamp which would be in the background.
Figure 21:
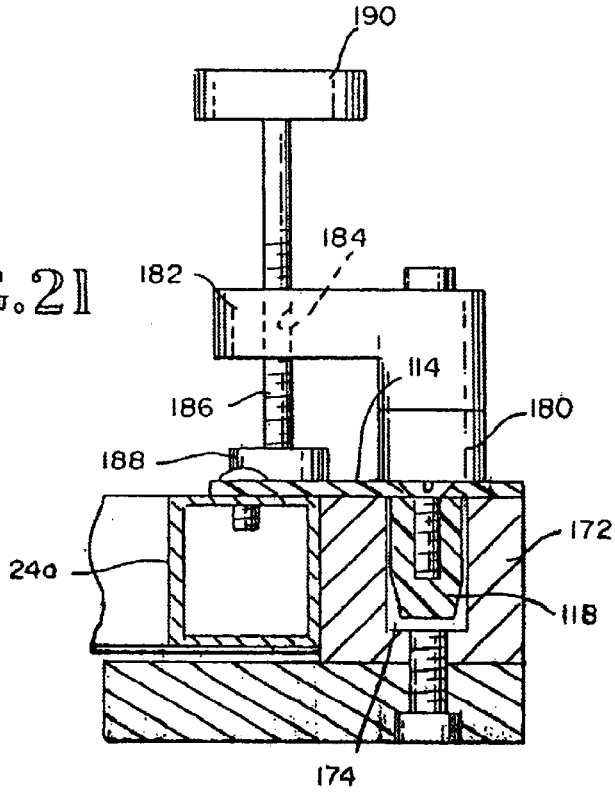
FIG. 21 is a sectional view taken substantially along line 6—6 of FIG. 20, but with the clamp member rotated over into a position with its clamp member above the member that connects the locator pin to the print screen frame.

FIGS. 19–21 relate to a modified way of mounting the print screen that is shown by FIGS. 10 and 11. In this embodiment, the member 110 shown in FIGS. 10 and 11 is replaced by a member 150. It is connected to a member 152 that in turn is connected to the end of a support arm 154 that takes the place of support arm 20. The end of member 154 that is not shown is pivotally attached to a support column or other support member, such as the way that support arm 20 is connected. A pair of screws 156, 158 may be provided for connecting the member 150 to the member 152. The screws 156, 158 included threaded shanks 160, 162 which extend through openings 162 and 164 in member 150 and screw into threaded openings 166 and 168 in member 152.

A pair of blocks 170, 172 are connected to the opposite ends of member 150. These blocks 170, 172 include sockets 174 that are like socket 112 in FIGS. 10 and 11. Blocks 170, 172 also mount a pair of clamps 176, 178. The clamps 176, 178 each include a post portion 180 (FIG. 21) that is mounted for pivotal movement about a vertical axis. The post portion 180 carries an arm 182 that includes a threaded opening 184 that receives a threaded shank 186. The lower end of shank 186 carries a clamp member 188. The upper end carries a knob 190. As shown by FIGS. 20 and 21, the arm 182 is rotatable between a first position in which the clamp member 188 is spaced away from plate 114 and a second position in which it is spaced above a central portion 190 of plate 114 that is identified by a broken line circle 192 in FIG. 20. When clamp member 188 is over region 192, the handle 190 is rotated to cause member 188 to move downwardly against plate 114. As it moves, member 188 clamps the plate 114 between itself and the block 172. The same thing occurs at the opposite end of member 150 with the other clamp 176 and the plate 114 that is associated with it. FIG. 21 shows the locator pin 118 within the socket 174 and the clamp member 188 bearing down on plate 114 and the frame member 24*a* below it. As can be readily appreciated, the clamp arms and clamp members can be easily and quickly rotated between their out of the way position (FIG. 20) and their clamping position (FIG. 21). By a quick and easy turn of the knobs 190, the clamp members 188 can be lifted and lowered relative to the plates 114. When they are down against the plates 114, they secure the print screen frame 24 to the mounting members 150, 152 that are secured to the support arm 154.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed is:

1. A screen printing device, comprising:

a support base;

a screen frame support on said support base;

a screen frame connectable to the screen frame support, said screen frame including a print screen;

a lower support on said support base;

a light box including upwardly directed lights and a portion below the lights that is sized and shaped to fit on and be supported by the lower support;

a workpiece support table having an upper workpiece support surface and a lower portion that is sized and shaped to fit on and be supported by the lower support; and said light box and said workpiece support table being interchangeably mounted on said lower support, whereby the light box, with its lights directed upwardly, can be placed on and be supported by the lower support, and then the light box can be removed from the lower support and the workpiece support table with its workpiece support surface directed upwardly, can be placed on and be supported by the lower support.

2. The screen printing device of claim 1, wherein the lower support is an elongated support arm extending in cantilever fashion from a portion of the support base.

3. The screen printing device of claim 1, wherein the portion of the light box below the lights that is sized and shaped to fit onto and be supported by the lower support is a socket that is sized and shaped to receive the support arm.

4. The screen-printing device of claim 2, wherein the lower portion of the workpiece support table that is sized and shaped to fit onto the lower support is a socket that is sized and shaped to receive the support arm.

5. The screen printing device of claim 1, comprising a pin and socket connection between the screen frame and the screen frame support, comprising at least two spaced apart locator pins and complementary end sockets that are sized, shaped and positioned to receive the locator pins, whereby said screen frame can be connected to the screen frame support by moving the screen frame towards the screen frame support and the locator pins into the locator pin sockets, and whereby when the locator pins are within the locator pin sockets the screen frame is in a predetermined position relative to the screen frame support and the lower support.

6. The screen-printing device of claim 5, wherein the locator pins and the locator.

7. The screen printing device of claim 5, wherein the screen frame support includes a clamp plate and at least one clamp screw, said clamp plate being positioned to be movable against a portion of the screen frame when the locator pins are within the locator pin sockets, and said clamp screw being adapted to move the clamp plate into clamping engagement with the screen frame.

8. The screen-printing device of claim 7, comprising two spaced apart clamp screws that are attached to the clamp plate.

9. The screen-printing device of claim 5, wherein the locator pins are connected to the screen frame and the locator pin sockets are connected to the screen frame support.

10. The screen-printing device of claim 1, wherein the screen frame support has first and second ends, its first end is mounted for pivotal movement about a horizontal axis and its second end is connected to the screen frame.

11. The screen printing device of claim 10, wherein the second end of the screen frame support is connected to the screen frame by a pin and socket connection comprising at least two spaced apart locator pins and complementary pin sockets that are sized, shaped and positioned to receive the locator pins.

12. A screen printing device, comprising:

a screen frame support;

a screen frame including a print screen;

a pin and socket connection between the screen frame and the screen frame support, comprising at least two spaced apart locator pins and complementary pin sockets that are sized, shaped and positioned to receive the locator pins;

whereby said screen frame can be connected to the screen frame support by moving the screen frame towards the screen frame support and the locator pins into the locator pin sockets;

whereby when the locator pins are within the locator pin sockets the screen frame is in a predetermined position relative to the screen frame support;

wherein the locator pins and the locator pin sockets are substantially parallel with the print screen; and wherein the screen frame support includes a clamp plate and two spaced apart clamp screws that are attached to the clamp plate, said clamp plate being positioned to be movable against a portion of the screen frame when the locator pins are within the locator pin sockets, and said clamp screws being adapted to move the clamp plate into clamping engagement with the screen frame.

13. The screen-printing device of claim 12, wherein the locator pins are connected to the screen frame and the locator pin sockets are connected to the screen frame support.

14. The screen printing device, comprising:

a screen frame support;

a screen frame including a print screen;

a pin and socket connection between the screen frame and the screen frame support, comprising at least two spaced apart locator pins and complementary pin sockets that are sized, shaped and positioned to receive the locator pins;

whereby said screen frame can be connected to the screen frame support by moving the screen frame towards the screen frame support and the locator pins into the locator pin sockets;

whereby when the locator pins are within the locator pin sockets, the screen frame is in a predetermined position relative to the screen frame support;

wherein the screen frame support has first and second ends, its first end is mounted for pivotal movement about a horizontal axis and its second end is connected to the screen frame by the pin and socket connection;

wherein the locator pin and the locator pin sockets are substantially parallel with the print screen; and wherein the screen frame support includes a clamp plate and two spaced apart clamp screws that are attached to the clamp plate, said clamp plate being positioned to be movable against a portion of the screen frame when the locator pins are within the locator pin sockets, and said clamp screws are adapted to move the clamp plate clamping arrangement the screen frame.

15. The screen-printing device of claim 14, wherein the locator pins are connected to the screen frame and the locator pin sockets are connected to the screen frame support.

16. The screen printing device of claim 14, further comprising a support column including a rotor that is mounted for rotation about a vertical axis, wherein the screen frame support has first and second ends, its first end is mounted on the rotor for pivotal movement about a horizontal axis and its second end is connected to the screen frame by the pin and socket connection.

* * * * *